United States Patent [19]

Newland

[11] Patent Number: 4,472,614

[45] Date of Patent: Sep. 18, 1984

[54] ELECTRIC SWITCH WITH IMPROVED SLIDING CONTACT HOLDER

[75] Inventor: Billy D. Newland, Arab, Ala.

[73] Assignee: Eaton Corporation, Cleveland, Ohio

[21] Appl. No.: 459,169

[22] Filed: Jan. 19, 1983

[51] Int. Cl.[3] ..... H01H 1/50

[52] U.S. Cl. ..... 200/153 M; 200/76; 200/153 LA; 200/253

[58] Field of Search ..... 200/76, 153 LA, 153 M, 200/253, 260, 291, 77

[56] References Cited

U.S. PATENT DOCUMENTS

| | | | |
|---|---|---|---|
| 362,469 | 5/1887 | Swan | 200/159 R |
| 1,169,099 | 1/1916 | Wilcox et al. | 200/153 M |
| 1,354,713 | 10/1920 | Apple | 200/77 X |
| 1,866,563 | 7/1932 | Hammell | 200/153 M |
| 2,210,037 | 8/1940 | Meuer | 200/76 |
| 2,750,479 | 6/1956 | Guboff | 200/253 |
| 3,250,884 | 5/1966 | Larkin | 200/253 |
| 4,326,110 | 4/1982 | Zdanys, Jr. | 200/291 X |

FOREIGN PATENT DOCUMENTS

| | | | |
|---|---|---|---|
| 957644 | 5/1964 | United Kingdom | 200/153 M |

*Primary Examiner*—John W. Shepperd
*Assistant Examiner*—Renee S. Kidorf
*Attorney, Agent, or Firm*—C. H. Grace; L. G. Vande Zande

[57] ABSTRACT

An insulating contact holder (26) is reciprocally movable in sliding engagement between flexible stationary contacts (22, 24) to interrupt the circuit therebetween in one position of the holder and to carry a contact (32) into bridging engagement with said stationary contacts in another position of the holder. A wedge formation (40) on the holder separates the stationary contacts a predetermined distance in the circuit interrupting position, and movement therefrom to the bridging position causes said stationary contacts (22, 24) to converge immediately prior to engagement by the bridging contact (32), thereby to relieve the bias in the stationary contacts prior to said bridging engagement to reduce contact bounce. The wedge surfaces (42) are provided with a matte surface for cleaning the stationary contacts.

15 Claims, 3 Drawing Figures

Fig. 1
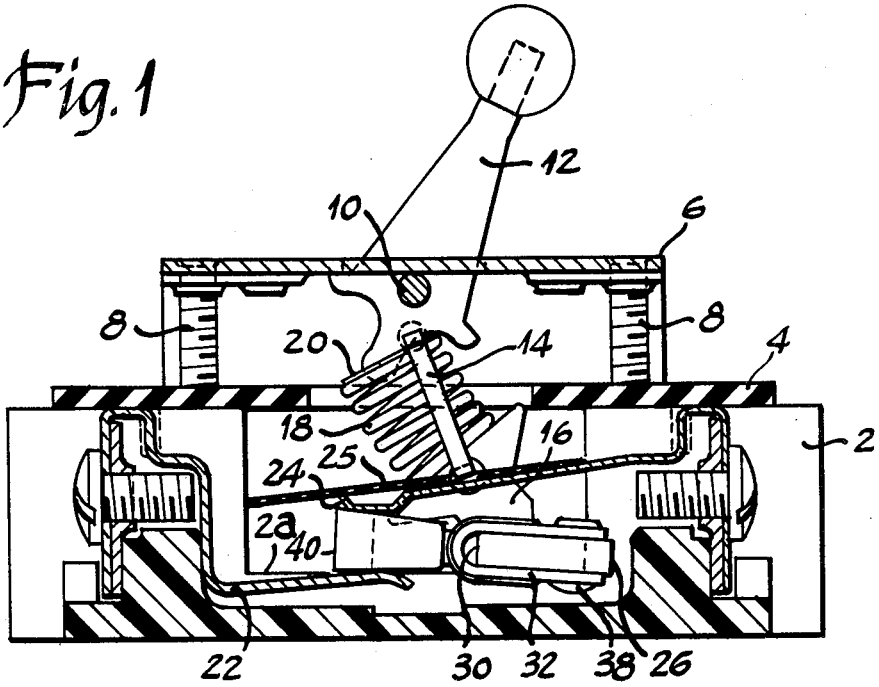
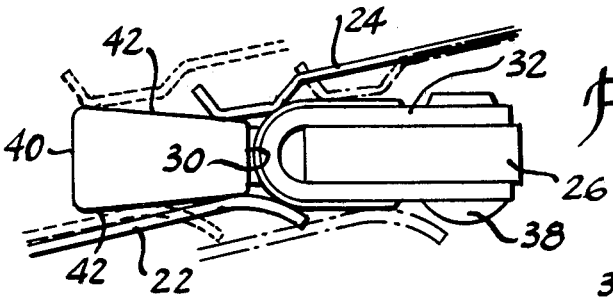
Fig. 2
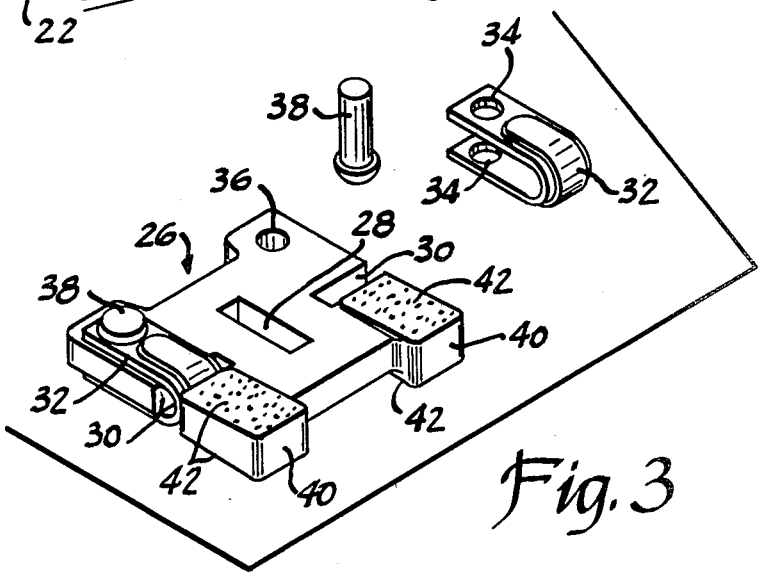
Fig. 3

ELECTRIC SWITCH WITH IMPROVED SLIDING CONTACT HOLDER

BACKGROUND OF THE INVENTION

This invention relates to electric switches and more particularly to snap action switches wherein a bridging contact is slidably driven into and out of bridging engagement with a pair of flexible stationary contacts.

U.S. Pat. No. 2,210,037 issued Aug. 6, 1940 to G. J. Meuer discloses a switch of the aforementioned type wherein the stationary contacts comprise resilient members supported on opposite end walls of the switch housing and having free ends overlying each other in spaced apart relationship within the central portion of the housing. A bridging contact is mounted on a insulating contact holder which is driven by an overcenter toggle mechanism for reciprocal sliding movement to carry the contact into and out of bridging engagement with the free ends of the stationary contacts. The contact holder is blanked, or sheared from a flat sheet of fiberboard and the bridging contact is a U-shaped member disposed within a lateral slot in the fiberboard contact holder to have the legs of the contact disposed horizontally along upper and lower surfaces of the contact holder. A rivet is provided through the fiberboard contact holder and the outer ends of the legs of the U-shaped bridging contact to maintain the contact assembled to the contact holder. Operation of the toggle mechanism drives the contact holder and bridging contact to a first position wherein the contact is disposed in bridging engagement with and between the upper and lower flexible stationary contacts to complete a circuit therebetween. Operation of the toggle mechanism to an opposite position drives the contact holder and bridging contact in an opposite direction to move the contact out of bridging engagement with the stationary contacts and to position a portion of the insulating contact holder between the free ends of the stationary contacts, thereby interrupting the circuit therebetween. Switches of this type have proven to perform very satisfactorily. However, the fiberboard contact holder is susceptible to swelling when the switch is used in humid, moist atmospheres, is susceptible to erosion from the electric arc that occurs upon contact separation, and can become brittle with very long life.

An improvement in the contact holder design is disclosed in U.S. Pat. No. 3,250,884 issued May 10, 1966 to R. E. Larkin. That contact holder is molded of an insulating phenolic resin and has U-shaped contacts which are assembled to the sides of the contact holder in lateral recesses as opposed to slots. The contacts have off-set legs which extend in the direction of motion of the contact holder to attain the desired length, and are recessed to be flush with the surface of the holder. The contacts are formed of good arc interrupting material and have a high quality current conducting material inlaid in the area of bridging engagement with the stationary contacts for enhanced performance. That contact holder is moisture resistant and less susceptible to arc erosion. Transversely disposed serrations are provided in that contact holder which engage the stationary contacts in the off position of the switch. Among other functions, these serrations provide a mild abraiding of the contacts for cleaning residue therefrom during movement of the holder. Testing and studies conducted on this switch suggest that the serrations may impart a vibration to the resilient stationary contacts during switch operation which may result in contact bounce and arcing upon bridging engagement of the contacts.

Switches of the aforementioned type are used extensively in industrial grade hand held portable electric tools. In some applications, particularly for tools manufactured in Europe, the separation distance between stationary contacts in the switch off position is required to be greater than presently exists in these switches. A direct solution to this requirement is to increase the thickness of the contact holder at the point where it engages the stationary contacts in the off position. The fiberboard contact holder such as in the aforementioned Meuer patent is not readily deformable to produce formations for this purpose, although such features can readily be incorporated on a molded contact holder such as in the aforementioned Larkin patent. In determining the nature of such formations, it has been discovered that particular configurations increase the circuit making and breaking performance of switches of this type.

SUMMARY OF THE INVENTION

The invention herein disclosed provides an improved insulating contact holder for switches wherein the contact holder is slidably disposed between a pair of resilient stationary contacts to separate the latter in the off position of the switch and to carry a bridging contact into and out of bridging engagement with the stationary contacts. The contact holder herein disclosed is made from a heat stable nylon material and has a wedge formed thereon which increases in thickness away from the bridging contact in the direction of movement of the contact holder so as to maintain the stationary contacts separated at a predetermined distance in the off position of the switch. Movement of the contact holder to the on position of the switch causes the stationary contacts first to converge as the declining surface of the wedge slides between the stationary contacts and thereafter to separate as the stationary contacts ride onto the bridging contact to their switch on, bridging contact position. The wedge surface is provided with a matte finish to provide mild abraiding for cleaning the stationary contacts.

BRIEF DESCRIPTION OF THE DRAWINGS

FIG. 1 is a longitudinal section through one pole of an electric switch embodying the slidable contact holder of this invention;

FIG. 2 is a fragmentary view drawn to an enlarged scale of the slidable contact holder, bridging contact and portions of the stationary contacts depicted in different operating positions; and FIG. 3 is an isometric view of the contact holder assembly of this invention with one bridging contact assembled and another bridging removed therefrom.

DESCRIPTION OF THE PREFERRED EMBODIMENT

Referring to the drawing, a switch embodying this invention is shown in FIG. 1 wherein a longitudinal section has been taken through one pole of a 2-pole switch. The switch comprises an insulating base 2, an insulating cover 4 and an actuator superstructure comprising an inverted U-shaped channel 6 secured to the base 2 by a pair of screws 8. The channel 6 serves to pivotally support a shaft 10 on which a toggle lever 12 is mounted to extend upwardly through an opening in the channel. A generally U-shaped bail 14 is also pivotally mounted between the upright legs of channel 6 to depend through an opening in cover 4 into a central cavity in base 2. A depending actuator tongue 16 is supported on the bight portion of bail 14 and a coil compression spring 18 is disposed between the actuator tongue 16 and the toggle lever 12. A cup washer 20 is disposed over the upper end of compression spring 18 for engagement by the toggle lever 12. A lower stationary contact 22 is supported on the left-hand end wall of base 2, the contact 22 having an inwardly extending resilient arm which projects toward the center of a central cavity of base 2 near a lower wall of that cavity. An upper stationary contact 24 is similarly secured on the right-hand end wall of the base 2 and has an inwardly extending resilient arm which projects toward the center of the switch cavity to overlie the free end of contact 22 in spaced apart relation. The contacts 22 and 24 are made of a spring contact material, the lower stationary contact 22 being made of a somewhat thicker material stock than the upper stationary contact 24 to provide greater rigidity to the lower stationary contact 22. Screw terminals are provided adjacent the outer ends of the stationary contacts 22 and 24 for connection of the switch contacts into an electrical circuit. An insulating sheet 25 is loosely disposed on the upper surface of upper stationary contact 24 and confined by the central cavity of base 2 to electrically insulate the toggle mechanism from the switch contacts.

A movable contact holder 26 is slidably disposed within the cavity of the switch base 2 on a horizontally extending central rib 2*a*. Contact holder 26 is positioned between the free ends of the stationary contacts 22 and 24 to separate these contacts when the switch is in the off position. Contact holder 26 is best illustrated in the isometric view of FIG. 3 wherein it may be seen to comprise essentially a flat, H-shaped member of insulating material. This insulating material is preferably heat stable nylon such as Vydyne 22H available from Monsanto Chemical Company. Contact holder 26 has a slot 28 in the central cross bar portion thereof which receives the actuator tongue 16 of the overcenter actuator mechanism for the switch. A pair of tranverse lateral slots 30 are provided for receiving the bight portion of U-shaped bridging contacts 32 assembled to the contact holder such that their legs overlie and extend along the upper and lower surfaces of contact holder 26. The free outer ends of the legs of bridging contacts 32 are provided with a pair of aligned holes 34 which align with holes 36 in contact holder 26 when assembled thereto and rivets 38 are provided to extend through the contact holder and through the legs of the contacts within the holes 34 and 36 to secure the contacts 32 to the holder 26. With reference to the orientation of holder 26 in FIG. 3, the forward edge of lateral slots 30 define the shallow end of respective wedges 40 which are inclined to the right in FIG. 3 and to the left in FIGS. 1 and 2. Wedges 40 provide upper and lower ramp surfaces 42 which diverge away from the bridging contacts 32 in the direction of movement of contact holder 26. Ramp surfaces 42 of the wedges are formed with a roughened matte finish by providing an EDM (Electro Discharge Machining) surface in the die in which the holder is molded to provide mild abraiding for the stationary contacts as the holder 26 is moved therebetween to clean the stationary contacts without imparting vibratory motion to the contacts.

As viewed in FIG. 1, when the toggle lever 12 is moved to its right-hand position, the overcenter toggle linkage (bail 14, spring 18 and actuator tongue 16) causes actuator tongue 16 to drive contact holder 26 to its right-hand position within the cavity of switch base 2. This position is determined by engagement of the central web of contact holder 26 with upstanding portions of the switch base at the respective ends of the central cavity. In the right-hand position it can be seen that the wide end of the wedge portions 40 is disposed between the upper and lower stationary contacts 24 and 22, respectively, to maintain these contacts separated at a predetermined spacing. The resiliency and initial spacing of stationary contacts 22 and 24 maintains them continuously biased into contact with the upper and lower surfaces of contact holder 26. The wedge 40 acts in opposition to the bias of the stationary contacts to cam them apart, thereby introducing a mild stress to the stationary contacts in the off position.

Movement of the toggle lever 12 to the left-hand position with respect to the orientation in FIG. 1 will cause the toggle mechanism to slide the contact holder 26 to its left-hand position, thereby driving contacts 32 into bridging engagement between stationary contacts 22 and 24. Lower contact 22 is formed to project slightly above the plane of central rib 2*a* to insure good contact pressure with the lower leg of bridging contact 32. As a result, as seen in FIG. 1, the contact holder assembly rides up onto the lower stationary contacts 22 in moving toward the left-hand position.

With reference to FIG. 2, as the contact holder 26 moves to the left, the ramp surfaces 42 of wedge 40 move in a direction to permit the stationary contacts 22 and 24 to converge until the contacts 32 abut the stationary contacts at the base of the wedge adjacent slots 30 as shown in solid lines in FIG. 2. Thereafter the continued leftward movement of holder 26 carries the bridging contact 32 fully between the stationary contacts 22 and 24 to the position shown in dot-dash lines FIG. 2. The relative movement between the stationary and movable contacts is such that the stationary contacts may be described as riding up the curvature of the bight portion of briging contact 32 and onto the flat surfaces of the upper and lower legs of contact 32. It will be appreciated that the speed with which the holder 26 moves causes the bridging contact 32 to abruptly drive stationary contacts 22 and 24 apart when moving to bridging engagement therewith and that momentum imparted to the stationary contacts may carry the respective stationary contact temporarily off the flat surface of the bridging contact 32 at the point of transition from curvature to flat surface, i.e. contact bounce occurs. This contact bounce creates undesirable arcing between the stationary and movable contacts. However, it has been found that less contact bounce occurs on contact holders having the wedge 40 preceding the bridging contact in movement to the on position. The convergence of the stationary contacts 22 and 24 as the inclined ramp surfaces 42 of the wedge 40 are moved from between the stationary contacts reduces or relaxes the minimal stress (originally applied to the stationary contacts by the wedge 40) immediately prior to their separation by the bridging contact 32, and the harmonics of this action minimize the contact bounce. Moreover, on movement of the bridging contact 32 out of engagement with the stationary contacts 22 and 24, the ramp surfaces 42 engage the stationary contacts as the latter converge downward along the curved portion of contact 32 and begin to separate the contacts immediately as the wider portion of the wedge 40 is driven therebetween. This action reduces any arc that is formed between the contacts at separation.

While the electric switch with improved sliding contact holder of this invention has been disclosed in a single preferred embodiment herein, it is to be understood that the invention is susceptible to various modifications without departing from the scope of the appended claims.

I claim:

1. An electrical switching device comprising, in combination:

a pair of resilient, spaced apart stationary contacts;

an insulating contact holder disposed between said stationary contacts in sliding engagement therewith;

a bridging contact carried by said holder and movable therewith into and out of bridging engagement with said stationary contacts, said bridging contact first abutting and then divergently deflecting said stationary contacts during movement into said bridging engagement;

projecting portions on said holder for divergently deflecting said resilient stationary contacts a predetermined distance apart when said bridging contact is out of said bridging engagement; and wherein movement of said holder to carry said bridging contact into bridging engagement with said stationary contacts moves said projecting portions away from said stationary contacts to cause convergence of said stationary contacts immediately prior to said bridging engagement.

2. The invention defined in claim 1 wherein said projecting portions comprise ramps inclined away from said bridging contact in the direction of movement of said contact holder.

3. The invention defined in claim 2 wherein contact making surfaces of said bridging contact comprise portions spaced wider apart than are the ends of said ramps adjacent said bridging contact.

4. The invention defined in claim 3 wherein said contact making surfaces comprise transitional surfaces leading from said ramps to said wider spaced portions of said contact making surfaces.

5. The invention defined in claim 3 wherein said contact making surfaces comprise convex arcuate transitional surfaces leading from said ramps and being tangential with said wider spaced portions of contact surfaces.

6. The invention defined in claim 2 wherein said ramps comprise roughened surfaces for providing a mild abrasive cleaning action on said stationery contacts as said holder moves with respect to said stationary contacts.

7. The invention defined in claim 6 wherein said holder is molded and said roughened surfaces are provided with a matte finish.

8. The invention defined in claim 7 wherein said matte finish is an electro discharge machine finish.

9. The invention defined in claim 1 wherein said contact holder is molded of heat stable nylon.

10. In an electric switch, a pair of resilient spaced apart stationary contacts, a bridging contact movable between said stationary contacts into and out of bridging engagement with said stationary contacts, said bridging contact first abutting and then divergently deflecting said stationary contacts during movement into said bridging engagement, a molded insulating holder between said stationary contacts holding said bridging contact and being movable in sliding engagement with said stationary contacts, said holder having surfaces divergent away from said bridging contact in the direction of movement of said holder for increasing the spacing between said stationary contacts when said bridging contact is out of bridging engagement.

11. The invention defined in claim 10 wherein said bridging contact comprises contact making surfaces for engagement by said stationary contacts, which surfaces are spaced wider apart than the narrowest portion of said divergent surfaces.

12. The invention defined in claim 11 wherein movement of said holder to carry said bridging contact into said bridging engagement moves said divergent surfaces with respect to said stationary contacts to cause the latter to converge immediately prior to said bridging engagement and to be subsequently moved apart by said bridging contact as said bridging contact moves between said stationary contacts.

13. The invention defined in claim 10 wherein said divergent surfaces have a matte finish for cleaning said stationary contacts as said holder moves relative thereto.

14. The invention defined in claim 10 wherein said holder is molded of heat stable nylon.

15. In an electric switching contact structure wherein a bridging contact is slidably movable into and out of bridging engagement between a pair of resilient stationary contacts, said stationary contacts being biased toward each other and said bridging contact first abuts and then divergently deflects said stationary contacts when moved into bridging engagement therewith, said bridging contact being carried by an insulating holder which is slidably disposed between said stationary contacts when said bridging contact is out of bridging engagement therewith, the improvement comprising ramp means on said insulating contact holder declining toward said bridging contact in the direction of movement of said holder, said ramp means deflecting said stationary contacts against the bias thereof when said bridging contact is out of bridging engagement and affording relative converging movement of said stationary contacts as said holder carries said bridging contact toward bridging engagement, thereby to relax the bias in said stationary contacts prior to said bridging engagement.

* * * * *